US011561512B2

(12) United States Patent
Isambert et al.

(10) Patent No.: US 11,561,512 B2
(45) Date of Patent: Jan. 24, 2023

(54) HOROLOGICAL LIMITING DEVICE FOR A WATCH THAT INCLUDES AN OSCILLATOR AND MEANS FOR LIMITING A VARIATION RATE OF THE OSCILLATOR

(71) Applicant: Omega SA, Biel/Bienne (CH)

(72) Inventors: Pierre Isambert, Morbier (FR); Bernat Monferrer, St-Prex (CH); Timothee Jeanrenaud, Yverdon-les-Bains (CH)

(73) Assignee: Omega SA, Biel/Bienne (CH)

( * ) Notice: Subject to any disclaimer, the term of this patent is extended or adjusted under 35 U.S.C. 154(b) by 293 days.

(21) Appl. No.: 16/904,114

(22) Filed: Jun. 17, 2020

(65) Prior Publication Data

US 2021/0026303 A1 Jan. 28, 2021

(30) Foreign Application Priority Data

Jul. 23, 2019 (EP) ..... 19187814

(51) Int. Cl.
*G04B 17/28* (2006.01)
*G04B 17/26* (2006.01)

(52) U.S. Cl.
CPC ..... *G04B 17/285* (2013.01); *G04B 17/26* (2013.01)

(58) Field of Classification Search
CPC .... G04B 17/26; G04B 17/285; G04B 27/004; G04B 27/005; G04B 27/026; G04B 27/001; G04B 27/00
See application file for complete search history.

(56) References Cited

U.S. PATENT DOCUMENTS 6,846,104 B2 * 1/2005 Geyer ..... G04B 17/285 368/146
7,244,062 B2 * 7/2007 Golay ..... G04B 27/004 368/142

(Continued)

FOREIGN PATENT DOCUMENTS

CH 695 797 A5 8/2006
CH 707 928 A2 10/2014

(Continued)

OTHER PUBLICATIONS

Combined Taiwanese Office Action and Search Report dated Dec. 30, 2020 in Taiwanese Patent Application No. 109120389, 8 pages.

(Continued)

*Primary Examiner* — Edwin A. Leon
(74) *Attorney, Agent, or Firm* — Oblon, McClelland, Maier & Neustadt, L.L.P.

(57) ABSTRACT

A horological device including an oscillator of a watch and device for stopping this oscillator embedded in a carriage of a tourbillon or karussel, including a rod arranged to axially push a lifting finger into an active blocking position, against a first spring tending to recall same axially into a rest position in which it bears against a carriage wheel, which lifting finger includes a ramp radially repelling a stop finger against a second spring tending to radially distance same from the axis, which stop finger is remote from the axis when the lifting finger is in the rest position thereof, and, in the active blocking position of this lifting finger, the stop finger can interfere with a stop cam integral with a wheel set of the oscillator, in an angular position remote from the dead center position of the oscillator.

7 Claims, 4 Drawing Sheets

(56) References Cited

U.S. PATENT DOCUMENTS

| | | | | |
|---|---|---|---|---|
| 8,356,929 | B2 * | 1/2013 | Zaugg | G04B 17/285 368/127 |
| 8,939,639 | B2 * | 1/2015 | Heise | G04B 15/14 368/127 |
| 9,052,692 | B2 * | 6/2015 | Capt | G04B 15/06 |
| 9,058,020 | B2 * | 6/2015 | Rochat | G04B 17/28 |
| 9,996,054 | B2 | 6/2018 | Heise | |
| 2017/0060090 | A1 | 3/2017 | Heise | |

FOREIGN PATENT DOCUMENTS

| | | | |
|---|---|---|---|
| CN | 101846962 | A | 9/2010 |
| CN | 101846962 | B | 1/2012 |
| CN | 104049519 | A | 9/2014 |
| CN | 203965807 | U | 11/2014 |
| CN | 104570683 | B | 4/2017 |
| CN | 106970513 | A | 7/2017 |
| CN | 208172516 | U | 11/2018 |
| EP | 0 357 870 | A2 | 3/1990 |
| EP | 2 871 536 | A1 | 5/2015 |
| EP | 2 871 536 | B1 | 5/2015 |
| EP | 3 136 186 | A1 | 3/2017 |
| EP | 3 136 186 | B1 | 3/2017 |

OTHER PUBLICATIONS

European Search Report dated Feb. 3, 2020 in European Application 19187814.9 filed Jul. 23, 2019 (with English Translation), 4 pages.

Combined Chinese Office Action and Search Report dated Jun. 24, 2021 in Chinese Patent Application No. 202010716982.X, 7 pages.

* cited by examiner

HOROLOGICAL LIMITING DEVICE FOR A WATCH THAT INCLUDES AN OSCILLATOR AND MEANS FOR LIMITING A VARIATION RATE OF THE OSCILLATOR

CROSS-REFERENCE TO RELATED APPLICATION

This application claims priority to European Patent Application No. 19187814.9 filed on Jul. 23, 2019, the entire disclosure of which is hereby incorporated herein by reference.

FIELD OF THE INVENTION

The invention relates to a horological limiting device, for a watch, comprising an oscillator and comprising means for limiting the variation of rate of this oscillator in the different positions of said watch in space, said device comprising at least one tourbillon or a karussel, which comprises a carriage which is mounted such that it pivots about a carriage axis relative to a plate, which carries a fixed wheel when said limiting device comprises a tourbillon, which carriage carries said oscillator and comprises a carriage wheel arranged so as to be driven by an energy source of the watch or of a movement by way of a gear train, and which carriage carries an escapement mechanism arranged so as to engage with said oscillator, and comprising an escape pinion meshing with said fixed wheel when said limiting device comprises a tourbillon or meshing with a third wheel or a fourth wheel, comprised in said gear train, when said limiting device comprises a karussel.

The invention further relates to a watch comprising a horological movement comprising energy storage means, an oscillator, hand-setting means, and such a limiting device.

The invention relates to the field of mechanical watches with high chronometric precision equipped with tourbillons or karussels, and so-called second-stop or carriage-stop mechanisms arranged so as to finely adjust the state of the watch.

BACKGROUND OF THE INVENTION

British patent No. 674764 filed by HEPTINSTALL discloses a spring-finger for blocking a balance.

European patent No. 1617305B1 filed by MONTRES BREGUET discloses a control for manually stopping, via the stem, pad levers for blocking a balance.

European patent No. 2787400B1 filed by CHOPARD discloses a stop element, integral with a carriage such that it rotates therewith, and which is a disc coaxial to this carriage, axially displaced for axial friction with a balance.

European patent No. 2085832B1 filed by FREDERIC PIGUET discloses a friction clutch mechanism, by radially placing clutching elements at the ends of star-shaped arms in a cylindrical surface of a driving plate, under the axial effect of a clutch spring.

SUMMARY OF THE INVENTION

The invention proposes stopping a tourbillon or karussel carriage when setting the hands so as to adjust a watch to the nearest second.

For this purpose, the invention relates to a horological limiting device for limiting the variation of rate of an oscillator comprised in a watch, according to claim 1.

The invention further relates to a watch comprising a horological movement comprising energy storage means, an oscillator, hand-setting means, and such a limiting device.

BRIEF DESCRIPTION OF THE DRAWINGS

Other features and advantages of the invention will be better understood upon reading the following detailed description given with reference to the accompanying drawings, in which:

FIG. 1 shows the assembly from below, from the opposite side to that which is normally seen by the user; the rod is in a rest position, wherein the stop finger does not hinder the operation of the oscillator;

DETAILED DESCRIPTION OF THE PREFERRED EMBODIMENTS

Figure 1:
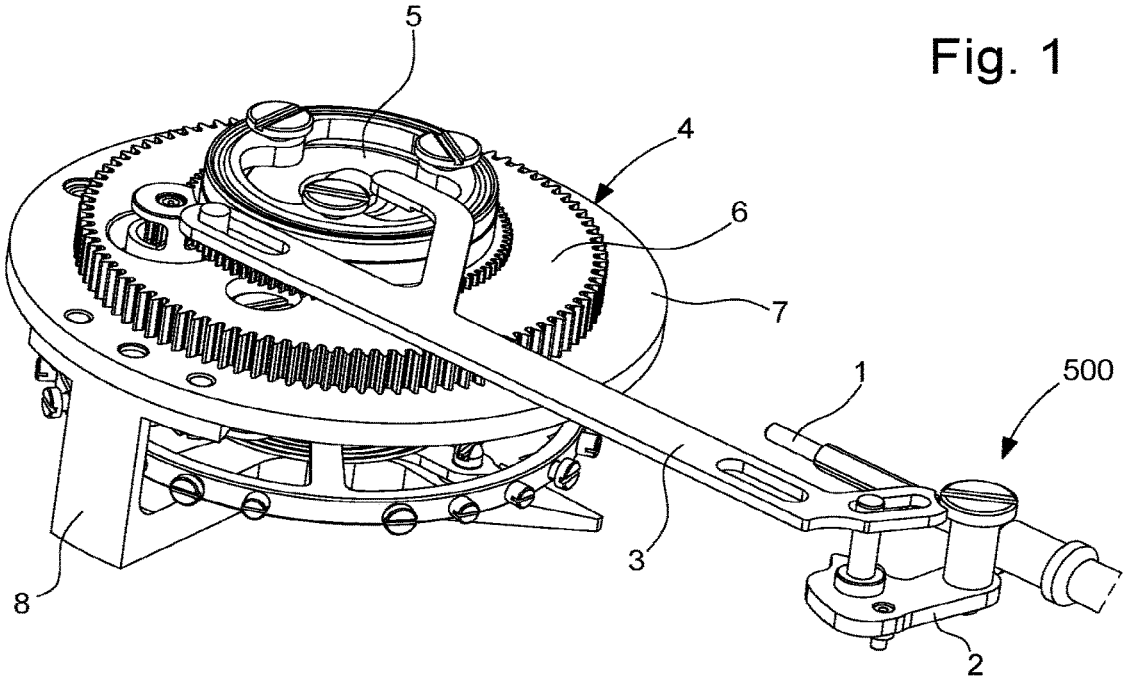
FIG. 1 diagrammatically shows a partial and perspective view of a horological limiting device for limiting the variation of rate of an oscillator, this oscillator, which is in this case a sprung balance oscillator, being carried by the carriage of a tourbillon, which carriage is integral with a carriage wheel to be driven thereby; the oscillator is pivoted between a lower carriage bridge and an upper carriage bridge; the limiting device comprises a stop mechanism, controlled by an engaging rod moved by a control member of the watch, in this case formed by a winding and setting stem; this engaging rod is arranged to radially move, relative to the carriage axis, a push-mechanism, comprising a lifting finger travelling a path perpendicular to that of the engaging rod and recalled by a first spring, and which is arranged to manoeuvre a stop finger perpendicular thereto, against a second spring.
Figure 2:
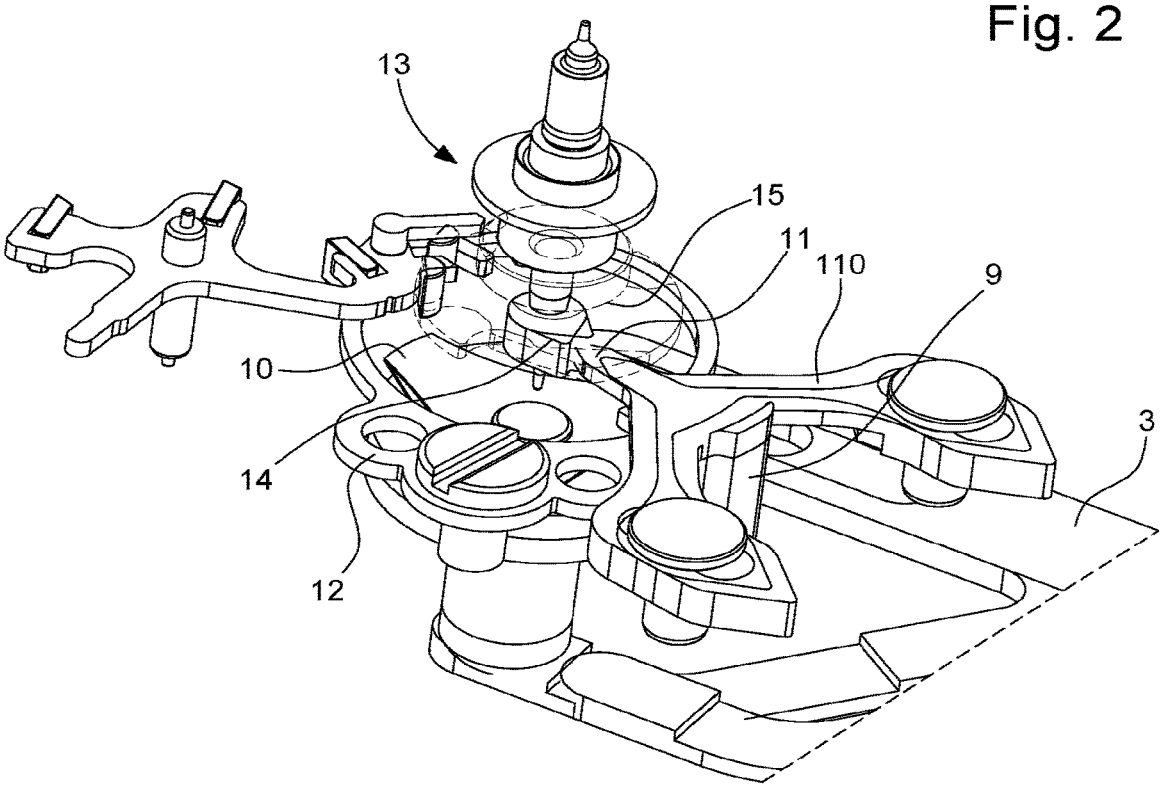
FIG. 2 diagrammatically shows a partial, perspective, overhead view of the mechanism in FIG. 1, with the carriage bridges, the balance felloe, and the balance spring not being shown; only the engaging rod, the lifting finger and the first spring thereof, the stop finger and the second spring thereof, and the balance double roller integral with a stop cam, with which the stop finger can engage to block the oscillator, are shown.
Figure 3:
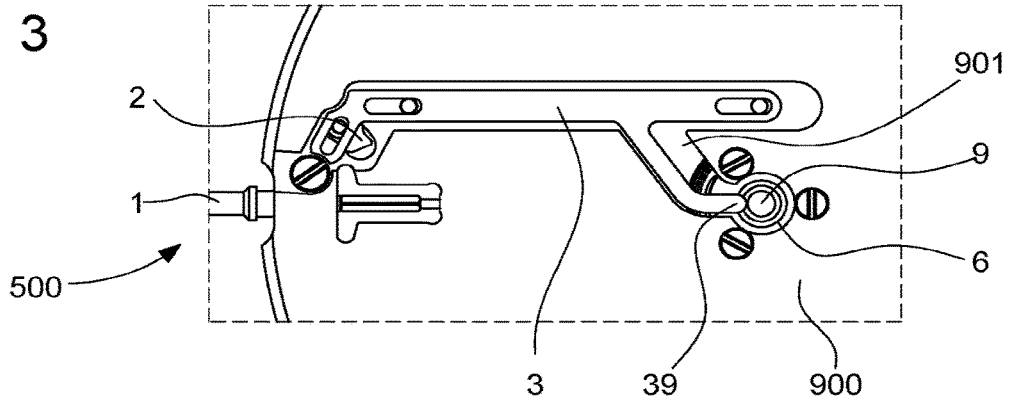
FIG. 3 diagrammatically shows a partial, planar, bottom view of the plate of the watch carrying the control rod, the pull-out piece, the engaging rod, and the lower end of the lifting finger.
Figure 4:
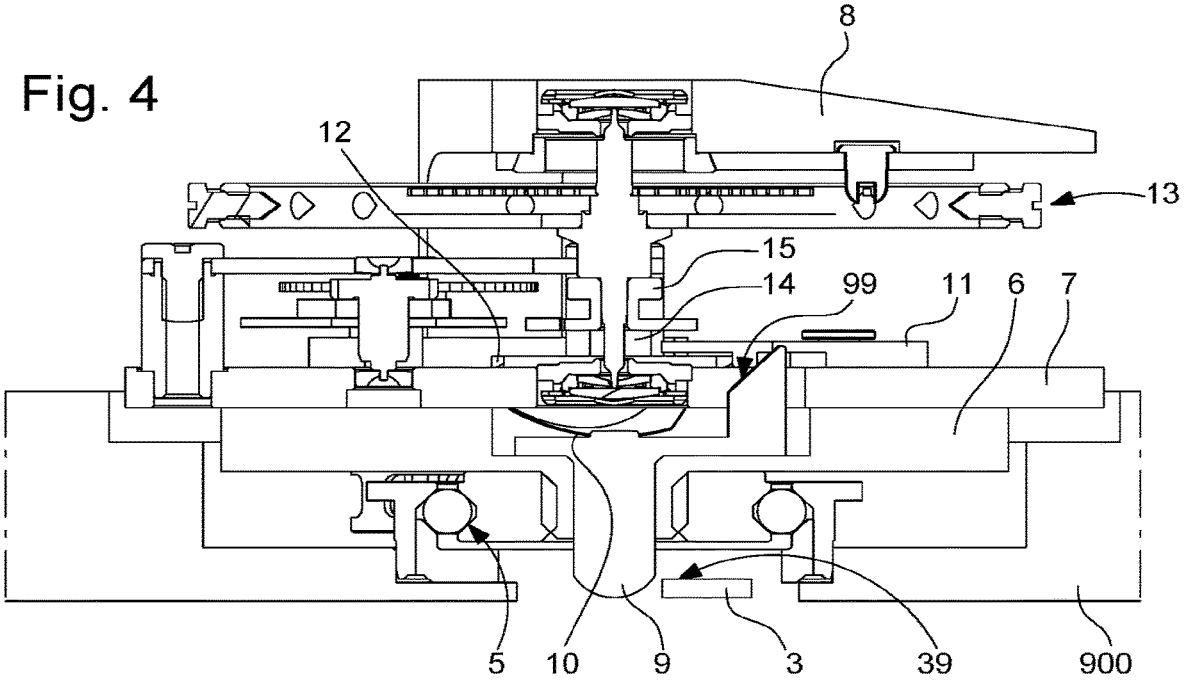
FIG. 4 diagrammatically shows a sectional view through the carriage axis, of the entire push-mechanism described above, in the rest position.
Figure 5:
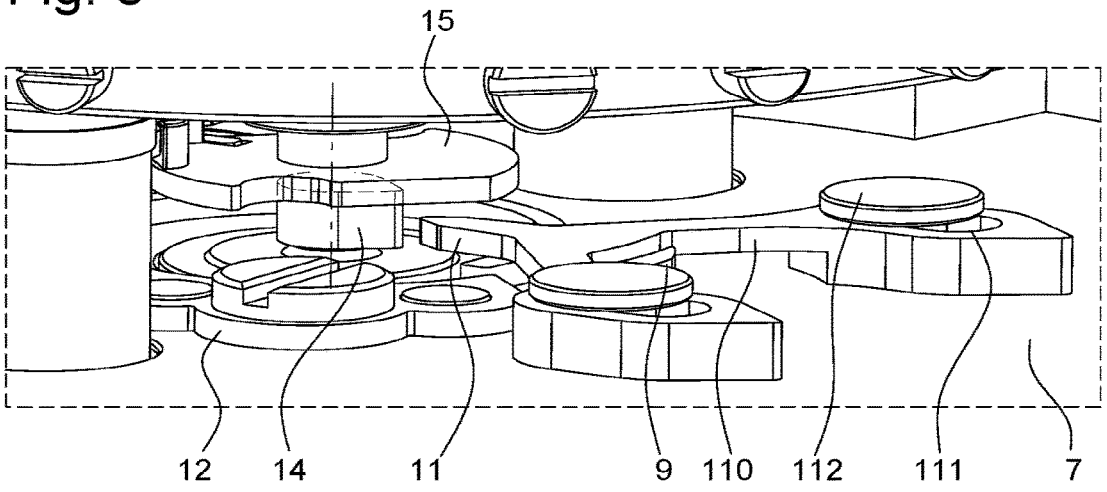
FIG. 5 diagrammatically shows a partial, perspective, overhead view of the same mechanism in the rest position, showing the stop finger positioned remotely from the stop cam, with which it cannot interfere, this position corresponding to the lowest position of the lifting finger shown in FIG. 4.
Figure 6:
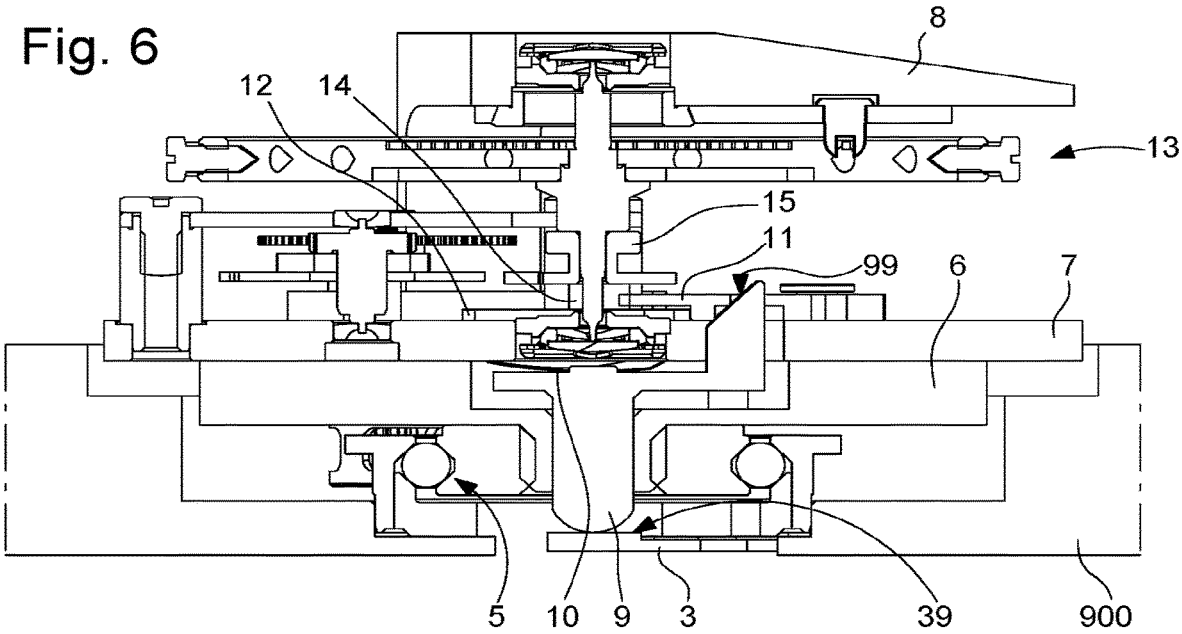
FIG. 6 shows, similarly to FIG. 4, the same mechanism, in an active position, wherein the lifting finger is raised, the ramp thereof repels the stop finger towards the carriage axis to block the stop cam.
Figure 7:
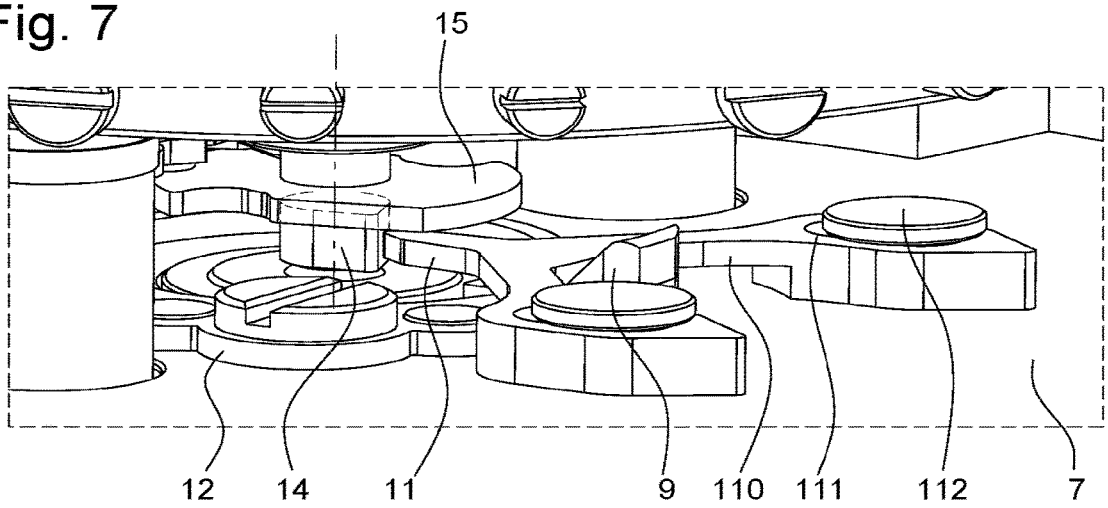
FIG. 7 diagrammatically shows, similarly to FIG. 5, the same mechanism with the control rod in the active position, with the stop finger blocking the stop cam.
Figure 10:
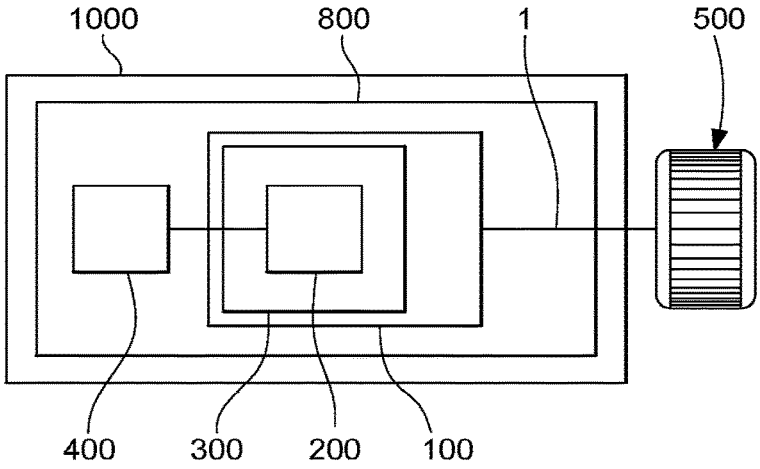
FIG. 10 is a block diagram showing a watch comprising a horological movement comprising energy storage means, an oscillator, hand-setting means, and such a limiting device.
Figure 8:
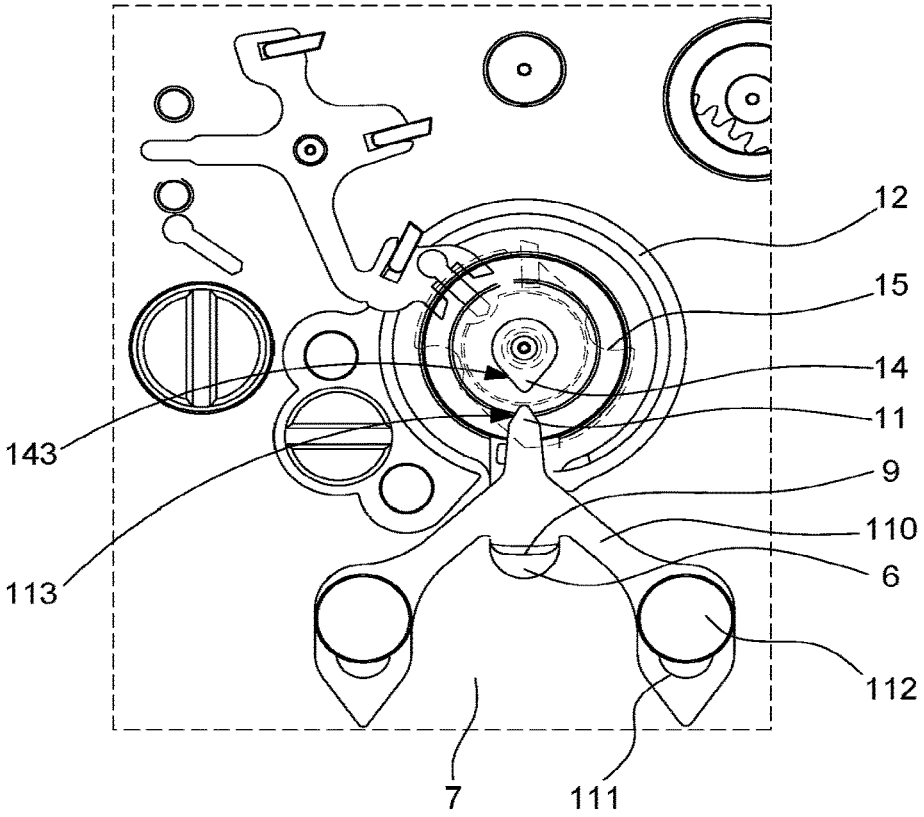
FIG. 8 diagrammatically shows a planar, overhead view of a feature of the engagement of the lifting finger and of the stop finger in the rest position T1.
Figure 9:
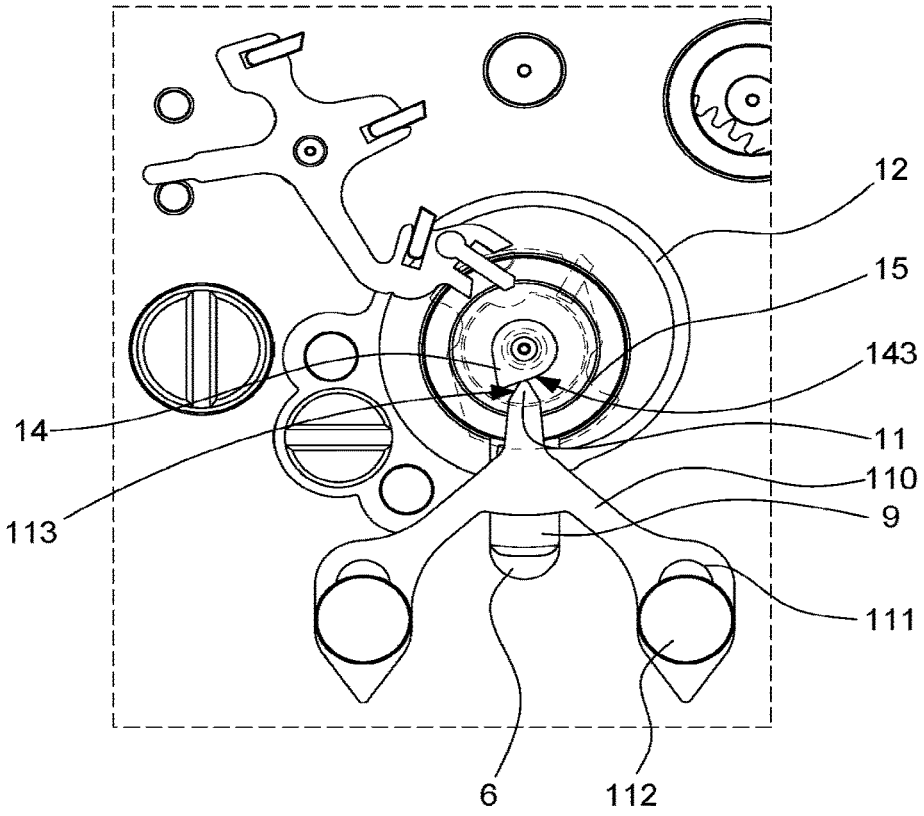
FIG. 9 diagrammatically shows a planar, overhead view of a feature of the engagement of the lifting finger and of the stop finger in the active position T2.

The invention relates to the field of mechanical watches with high chronometric performance levels.

Known methods of improving insensitivity to the positions of a watch 1000 involve equipping it with a horological limiting device 100, comprising an oscillator 200, comprising means for limiting the variation of rate of this oscillator 200, in the different positions of the watch 1000 in space.

This device 100 comprises at least one tourbillon 300 or a karussel which, in either case, comprises a carriage 4 which is mounted such that it pivots about a carriage axis D relative to a plate 900.

This plate 900 carries a fixed wheel 210 when the limiting device 100 comprises a tourbillon 300.

The carriage 4 carries the oscillator 200, and comprises a carriage wheel 6, which is arranged so as to be driven by an energy source 400 of the watch 1000 or of a movement 800 comprised in the watch, by way of a gear train. This energy source 400 can in particular comprise at least one barrel or similar element.

The carriage 4 further carries an escapement mechanism 700, which is arranged so as to engage with the oscillator 200, and which comprises an escape pinion 201.

The carriage 4 comprises a lower bridge 7 and an upper bridge 8. The upper carriage bridge 8 protects both the oscillator 200, the escapement mechanism 700, and the mechanism according to the invention.

This escape pinion 201 meshes with the fixed wheel 210 when the limiting device 100 comprises a tourbillon, or meshes with a third wheel or a fourth wheel, comprised in the gear train, when the limiting device 100 comprises a karussel.

The mechanism according to the invention allows the karussel or tourbillon carriage to be stopped when setting the hands.

According to the invention, the device 100 is capable of stopping the oscillator 200 and comprises a control rod 3, which is arranged to engage with a control member external to the tourbillon 300 or karussel.

This control rod 3 is arranged to axially push a lifting finger 9, in the direction of the carriage axis D, into an active blocking position. This push imparted by the control rod 3 is applied to this lifting finger 9 against a first elastic return means 90, which tends to axially bring the lifting finger 9 back to an axial rest position in which it bears against the carriage wheel 6, in the direction of the carriage axis D.

More particularly, the first elastic return means 90 is a foil plate cut by stamping or by a similar technique.

More particularly, the control rod 3 comprises a pushing surface 39, which is arranged to engage with the lifting finger 9, and which is a surface substantially orthogonal to the carriage axis D, or which comprises a gentle incline to ease the insertion thereof beneath the lifting finger 9. More particularly, the end of the lifting finger 9, which engages with this pushing surface 39, is locally spherical or curved.

This lifting finger 9 comprises a ramp 99 which is arranged to repel a stop finger 11, radially relative to the carriage axis D, against a second elastic return means 12 which tends to radially distance this stop finger 11 from the carriage axis D.

More particularly, the second elastic return means 12 is fixed to the lower carriage bridge 7, and is a substantially circular, open spring so as to free the axial space around the carriage axis D, and in particular space for housing a balance pivot, a balance double roller, a balance, or a similar element.

This stop finger 11 is in the radial position thereof located the furthest from the carriage axis D when the lifting finger 9 is in the rest position thereof.

According to the invention, in the active position blocking the lifting finger 9, the stop finger 11 is arranged to interfere with a stop cam 14, which is integral with a wheel set of the oscillator 200, and to block this stop cam 14 in an angular position remote from the dead centre position of the oscillator 200.

More particularly, the stop finger 11 constitutes the distal end of a fork 110 guided on the lower carriage bridge 7 in a radial direction relative to the carriage axis D, by the engagement of oblongs 111 and of pins 112, the second integral with the lower bridge 7 and the first integral with the fork 110, or vice-versa.

More particularly, the stop finger 11 comprises, at the contacting surface thereof with the stop cam 14, a tip 113 or a tapered surface.

More particularly, the stop cam 14 comprises, at the contacting surface thereof with the stop finger 11, a tip 143 or a tapered surface.

More particularly, the device 100 comprises hand-setting means 500, which constitute or which control the control member, which is arranged so as to move the control rod 3 in a first activation direction upon the passage of the hand-setting means 500 from a rest position T1 to an activated position T2, and to move the control rod 3 in a second direction opposite the first direction upon the passage of the hand-setting means 500 from the activated position T2 to the rest position T1.

In an alternative embodiment, the control rod 3 is further arranged so as to, under the effect of the external control member, push, substantially radially relative to the carriage axis D, a resilient strip 66 which is arranged so as to bear substantially tangentially against the carriage wheel 6 in order to stop the carriage 4 upon passage of the control member from a rest position to an active position, and so as to remain remote from the carriage wheel 6 when the control member is in the rest position thereof.

More particularly, the control rod 3 is arranged to block the wheel set of the oscillator, in a first course of travel then, in a second course of travel, to block the carriage, or vice-versa.

More particularly, the resilient strip 66 is more flexible than the first elastic return means 90, and is also more flexible than the second elastic return means 12.

More particularly, the oscillator 200 is a sprung balance assembly.

The invention further relates to a watch 1000 comprising a horological movement 800 comprising energy storage means 400, an oscillator 200, hand-setting means 500, and such a limiting device 100.

More particularly, the tourbillon 300 or karussel constitutes a display member of the watch 1000, or is arranged so as to drive at least one display member of the watch 1000, and the hand-setting means 500 constitute or control the control member.

In the non-limiting alternative embodiment shown in the figures, hand-setting means 500 constitute or control the control member, and comprise a conventional winding and setting stem 1, and the mechanism in particular comprises a pull-out piece 2, a control rod 3, a tourbillon carriage 4, a tourbillon bearing 5, a carriage wheel 6, a lower tourbillon bridge 7, an upper tourbillon bridge 8, a lifting finger 9, a lifting finger foil plate 10, a stop finger 11, a stop finger spring 12, a sprung balance 13, a stop cam 14, and a double roller 15 of the balance.

The operating principle is as follows:

in position T1, the mechanism is under the following conditions:

The control rod 3 is held in place by the pull-out piece 2. On the tourbillon, the lifting finger 9 is in the rest position, pressed against the tourbillon carriage wheel 6 by the lifting finger foil plate 10. The stop finger 11 is in the rest position on the lower tourbillon bridge 7, pressed against the lifting finger 9 by the stop finger spring 12. The sprung balance 13 oscillates freely between the upper tourbillon bridge 8 and the lower tourbillon bridge 7.

in position T2, the mechanism is under the following conditions:

The winding stem 1 is pulled out and drives the pull-out piece 2 therewith. The pull-out piece 2 displaces the control rod 3, which comes into contact with the lifting finger 9 and raises same. The lifting finger 9 is guided in the tourbillon carriage wheel 6. When rising, the lifting finger 9 compresses the lifting finger foil plate 10 against the lower tourbillon bridge 7 and pushes the stop finger 11 forwards. The latter then enters the circular trajectory of the sprung balance 13 and by way of the stop cam 14, which is integral with the balance, stops the movement of the balance in a preferred position, outside of the dead centre area of the double roller 15. This guarantees that the oscillator 200 is restarted when passing from T2 to T1. The stop finger spring 12 tends to push the stop finger 11 against the lifting finger 9, which guarantees that the stop finger 12 returns to its position when passing from T2 to T1.

The system is designed to stop the tourbillon, or respectively the karussel, when setting the hands.

The system rests against the carriage wheel with a strip spring which exerts sufficient pressure to stop the carriage.

To summarise, the invention allows:

a tourbillon or karussel carriage to be instantly stopped;

the time to be set to the nearest second;

the restarting of the oscillator to be guaranteed after setting the time.

Moreover, the system is, with the exception of the control rod, essentially integrated into the tourbillon carriage, which creates space inside the movement.

This mechanism is compact, the manufacture thereof requires conventional technology and the cost thereof is thus low.

The invention claimed is:

1. A horological limiting device for a watch comprising an oscillator and means for limiting a variation of rate of said oscillator in different positions of said watch, said horological limiting device comprising:

at least one tourbillon or a carrousel, which comprises a carriage mounted to pivot about a carriage axis relative to a plate carrying a fixed wheel, said carriage carries said oscillator and comprises a carriage wheel arranged so as to be driven by an energy source of the watch or of a movement, and said carriage carries an escapement mechanism arranged so as to engage with said oscillator, and comprising an intermediate escape pinion meshing with said fixed wheel, wherein said device is capable of stopping said oscillator and comprises a control rod arranged to engage with a control member external to said tourbillon or carrousel, to axially push a lifting finger in the direction of said carriage axis into an active blocking position, against a first elastic return means which tends to axially bring said lifting finger back, in a direction of said carriage axis, into an axial rest position wherein said first elastic return means bears against said carriage wheel, the lifting finger comprises a ramp arranged to repel a stop finger, radially relative to said carriage axis, against a second elastic return means which tends to radially distance said stop finger from said carriage axis, said stop finger is in the radial position thereof located the furthest from said carriage axis when said lifting finger is in the rest position thereof, and wherein, in the active position blocking said lifting finger, said stop finger is arranged to interfere with a stop cam integral with a wheel set of said oscillator, and block said stop cam in an angular position remote from a dead centre position of said oscillator.

2. The limiting device according to claim 1, wherein said device comprises hand-setting means, which constitute or control said control member arranged so as to move said control rod in a first activation direction upon the passage of said hand-setting means from a rest position T1 to an activated position T2, and to move said control rod in a second direction opposite said first direction upon the passage of said hand-setting means from said activated position T2 to said rest position T1.

3. The limiting device according to claim 1, wherein said stop finger constitutes a distal end of a fork guided on a lower carriage bridge comprised in said carriage, in a radial direction relative to said carriage axis (D), by an engagement of oblongs and of pins, a second integral with said lower bridge and a first integral with said fork, or vice-versa.

4. The limiting device according to claim 1, wherein said stop finger comprises, at a contacting surface thereof with said stop cam, a tip or a tapered surface.

5. The limiting device according to claim 1 wherein said stop cam comprises, at a contacting surface thereof with said stop finger, a tip or a tapered surface.

6. The limiting device according to claim 1, wherein said oscillator is a sprung balance assembly.

7. The watch comprising:

the horological movement comprising energy storage means, the oscillator, the hand-setting means, and the limiting device according to claim 1, comprising said oscillator, wherein said tourbillon or carrousel constitutes a display member of said watch, or is arranged so as to drive at least one display member of said watch, and wherein said hand-setting means constitute or control said control member.

* * * * *